United States Patent [19]

Alter

[11] 3,935,885

[45] Feb. 3, 1976

[54] CAPSULE-FILLING MACHINES

[76] Inventor: Richard R. Alter, 608 McDowell St., Delavan, Wis. 53115

[22] Filed: Feb. 1, 1974

[21] Appl. No.: 438,751

[52] U.S. Cl. ..... 141/279; 141/141; 141/191; 417/476

[51] Int. Cl.[2] ..... B67C 3/26; B67C 3/34

[58] Field of Search ..... 141/1, 2, 18, 25, 81, 140, 141/141, 156, 157, 164, 190, 191, 249, 270, 279, 284, 312, 327, 387, 388, 374, 250; 417/474, 476

[56] References Cited

UNITED STATES PATENTS

| | | | |
|---|---|---|---|
| 3,437,050 | 4/1969 | Hrdina | 417/476 X |
| 3,489,186 | 1/1970 | Riker | 141/141 |
| 3,593,761 | 7/1971 | Lorenz | 141/190 X |
| 3,658,445 | 4/1972 | Pulman et al. | 417/474 |
| 3,779,292 | 12/1973 | Mencacci | 141/374 X |

*Primary Examiner*—Richard E. Aegerter
*Assistant Examiner*—Frederick R. Schmidt
*Attorney, Agent, or Firm*—Johnson, Dienner, Emrich & Wagner

[57] ABSTRACT

A mechanism for feeding fluid into capsules in a capsule-filling machine embodying a cam-controlled roller movable into and out of squeezing relation to a flexible feed tube, and movable along the tube in a fluid-ejecting direction when disposed in such squeezing relation to the tube, with tube shut off means and ejector nozzle positioning means operable in timed relation to the actuation of the roller.

3 Claims, 14 Drawing Figures

2
3
4
6
9
10
18
19
20
21
22
23
24
25
26
27
28
29
30
32
33
34
35
36
37
38
39
42
43
46
47
47a
48
54
55
56
57
60
61
62
69
70
72
73
74
75
76
77
78
79
80
81
82
83
85
86
87

CAPSULE-FILLING MACHINES

BACKGROUND OF INVENTION

This invention relates to capsule-filling machines, and, more particularly, to mechanisms for feeding fluid into capsules in such filling machines.

It is a primary object of the present invention to afford a novel machine for filling capsules, and the like.

Another object of the present invention is to afford a novel mechanism for feeding fluid in capsule-filling machines. Another object is to afford a novel pump for use in capsule-filling machines.

Another object of the present invention is to afford a novel machine for inserting fluid into capsules of the type known in the trade as "straws", and which embody openings extending longitudinally therethrough.

Yet another object of the present invention is to afford a novel pumping mechanism which is effective to pump an accurately measured amount of fluid into a capsule.

A further object of the present invention is to afford a novel capsule-filling machine which is effective to automatically, sequentially fill capsules fed through the machine.

Another object of the present invention is to afford a novel capsule-filling machine embodying parts constituted and arranged in a novel and expeditious manner whereby, in the event of a malfunction of the machine the flow of fluid through the machine is automatically stopped.

Another object of the present invention is to afford a novel capsule-filling machine of the aforementioned type which is practical and efficient in operation, and which may be readily and economically produced commercially.

Other and further objects of the present invention will be apparent from the following description and claims and are illustrated in the accompanying drawings which, by way of illustration, show the preferred embodiment of the present invention and the principles thereof, and what I now consider to be the best mode in which I have contemplated applying these principles. Other embodiments of the invention, embodying the same or equivalent principles may be used and structural changes made as desired by those skilled in the art without departing from the present invention and the purview of the appended claims.

DESCRIPTION OF THE EMBODIMENT SHOWN HEREIN

A fluid-feeding mechanism 1 embodying the principles of the present invention, is shown in FIGS. 1–13 of the drawings to illustrate the presently preferred embodiment of the present invention.

Figure 1:
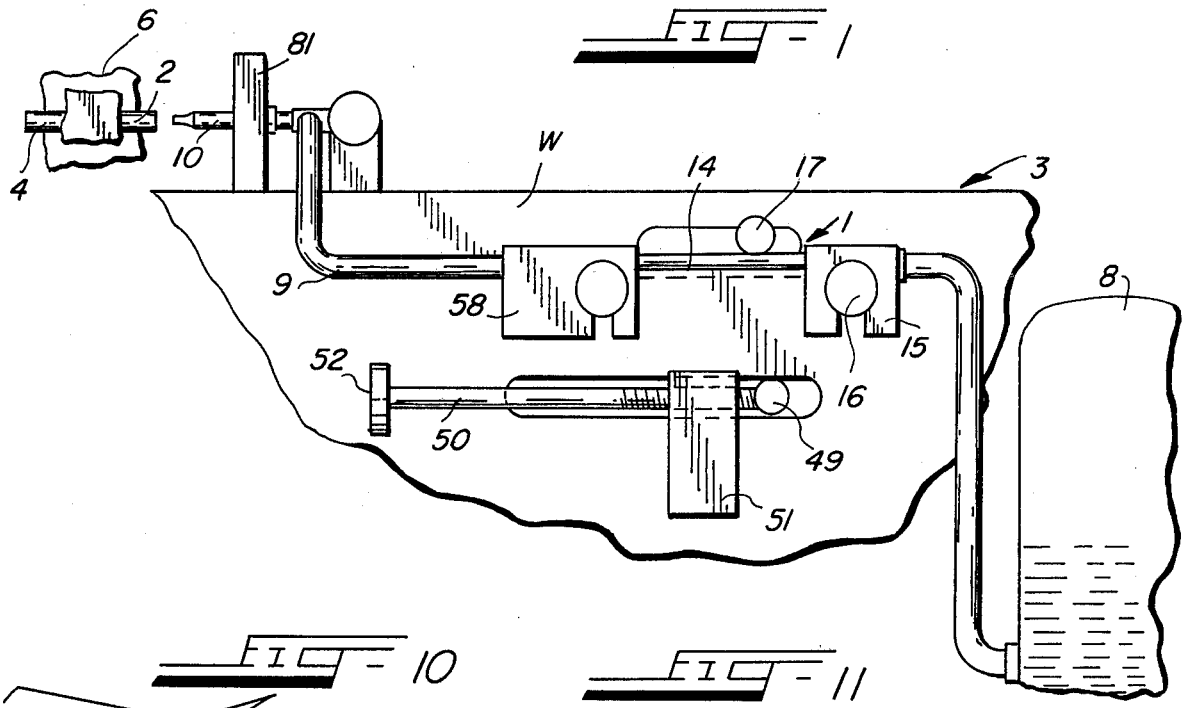
FIG. 1 is a somewhat diagramatic, fragmentary, front elevational view of a machine embodying the principles of the present invention.
Figure 14:
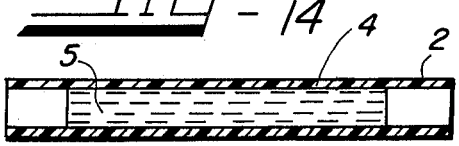
FIG. 14 is a longitudinal, sectional view of a "straw" type capsule, which is of the type particularly well adapted for use in the machine shown in FIG. 1, showing the capsule in filled condition.
Figure 2:
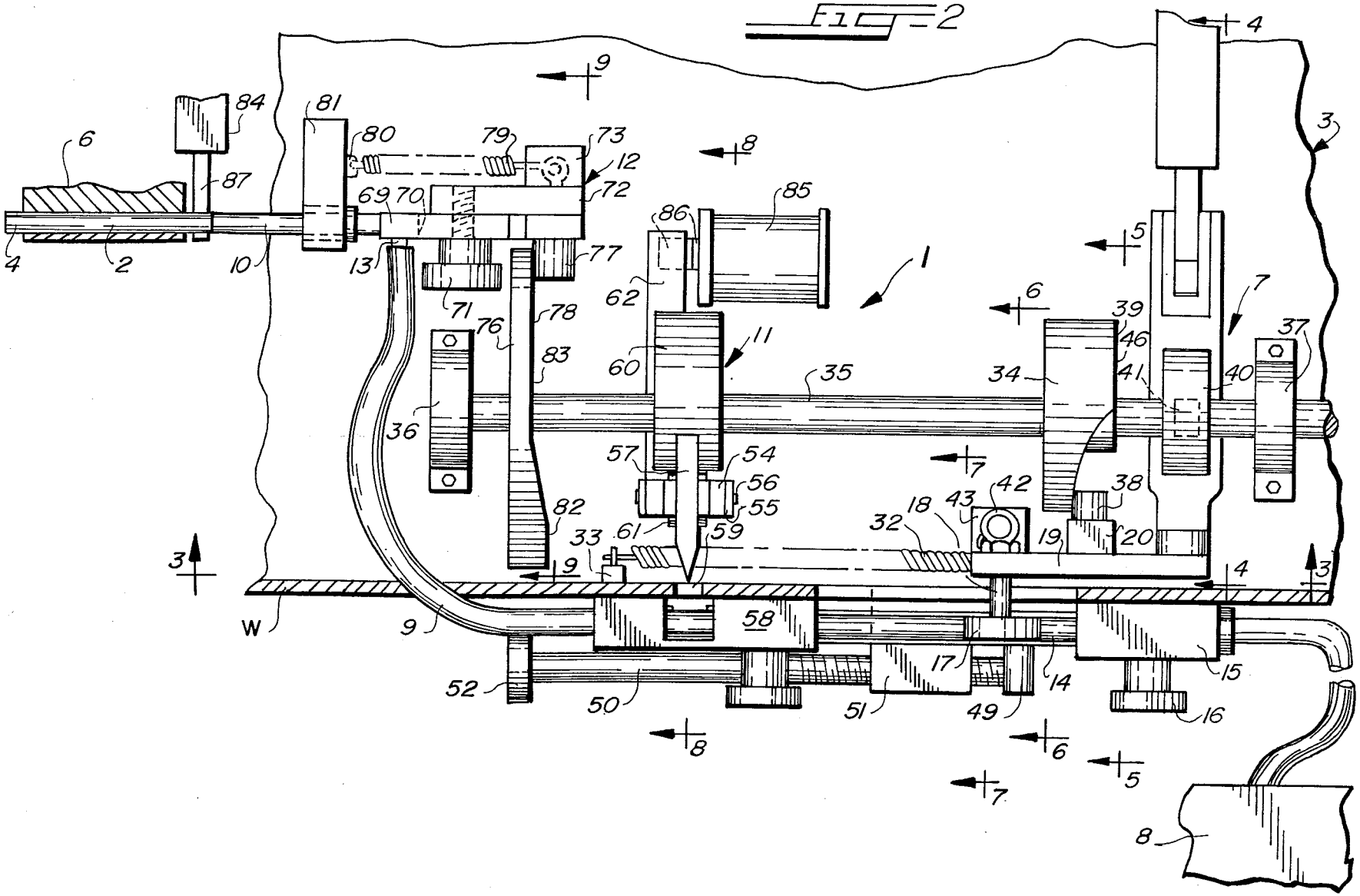
FIG. 2 is a fragmentary, top plan view of a portion of the machine shown in FIG. 1.
Figure 3:
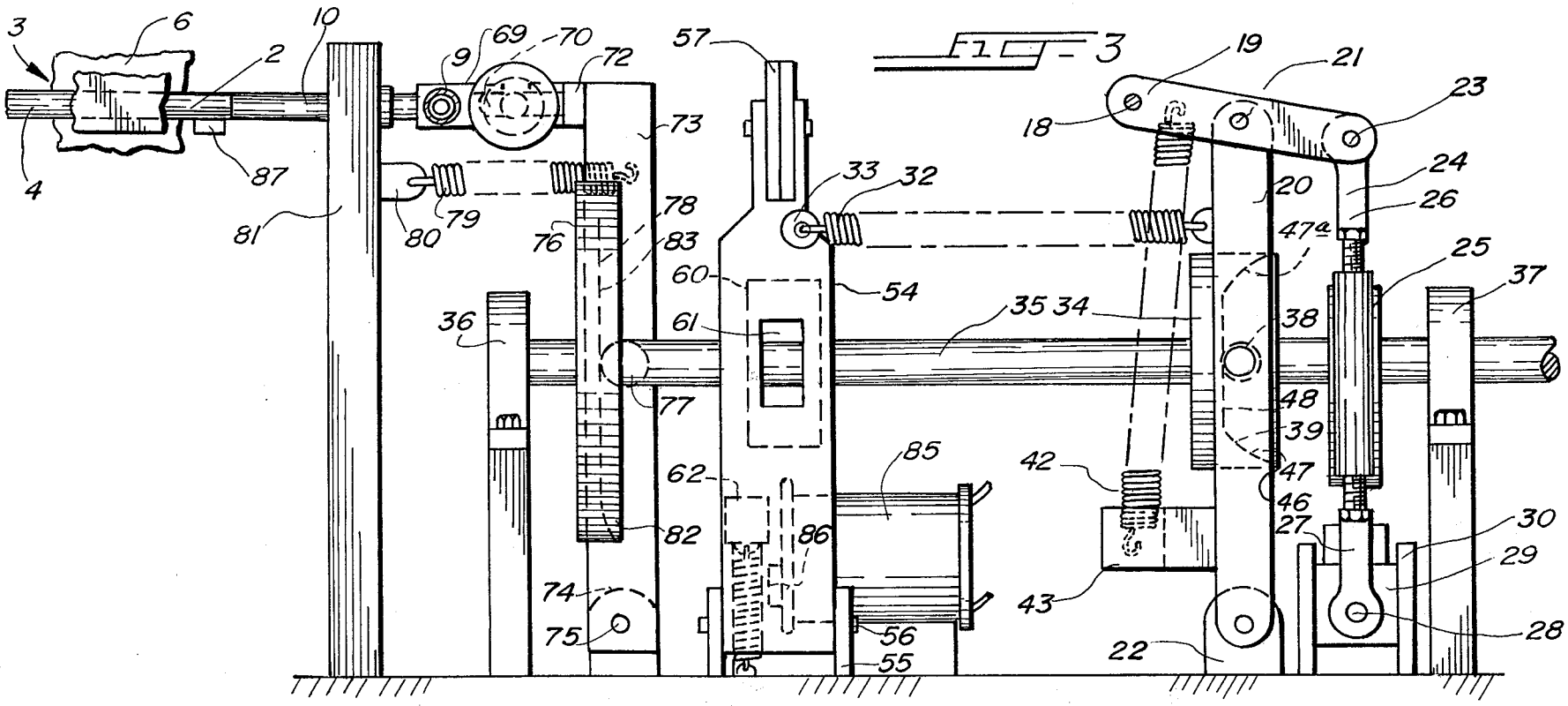
FIG. 3 is a fragmentary, detail sectional view taken substantially along the line 3—3 in FIG. 2.

The mechanism 1 is shown in FIGS. 1–3 in position to feed fluid into a capsule 2 disposed in fluid-receiving position in a capsule-filling machine 3, which is shown only fragmentarily. The capsule 2 is of the type commonly known in the trade as a "straw" and embodies an elongated, substantially straight tubular member 4. In its "filled" condition, the capsule 2 may contain a pre-determined amount of any suitable product 5, such as, for example, semen, as illustrated in FIG. 14. Preferably, prior to removal from the machine 3, the filled capsule 2 is plugged at both ends by any suitable means, such as, for example, by mechanisms of the type disclosed in my co-pending application for U.S. patent, Ser. No. 388,185, filed Aug. 14, 1973.

The tubular member 4 may be made of any suitable material, but preferably is made of a suitable plastic material, such as, for example, polypropylene, and the tubular member 4 may be of any suitable size, such as, for example, having a length of 2.5 inches, a wall thickness of 0.020 inch and an inside diameter of 0.105 inch. As will be appreciated by those skilled in the art, the capsule 2 is shown herein merely by way of illustration, and not by way of limitation, and other suitable sizes, types, and shapes of capsules may be used without departing from the purview of the broader aspects of the present invention.

The capsule-filling machine 3 embodies holding means 6, which are shown more or less diagramatically, FIGS. 1–3, and which may be of any suitable type for holding the tubular member 4 in the aforementioned fluid-receiving position in the machine 3.

The fluid-feeding mechanism 1 embodies, in general, FIGS. 2 and 3, a pumping mechanism 7 for feeding fluid from a suitable source of supply, such as, for example, a reservoir 8, through a suitable flexible, resilient tubular member, such as, for example, a flexible rubber or polypropylene tube 9, to an injection nozzle 10, from which it is fed into the capsule 2, the fluid-feeding mechanism 1 also embodying a flow-control mechanism 11, and a nozzle-control mechanism 12, for purposes which will be discussed in greater detail hereinafter.

One end of the tubular member 9 is operatively connected to the reservoir 8, and the other end thereof is operatively connected to the nozzle 10 through a coupling 13 embodied in the nozzle-control mechanism 12, FIG. 2. Between the reservoir 8 and the coupling 13 the tubular member 9 extends across the top of and is supported by a suitable supporting member 14 disposed on the front face of the front wall W of the machine 3, the tubular member 9 being releasably held in operative position on the supporting member 14 by suitable means such as an inverted L-shaped bracket 15 releasably secured to the supporting member 14 in overlying relation to the tubular member 9 by a screw or bolt 16, FIGS. 2 and 5.

Figure 5:
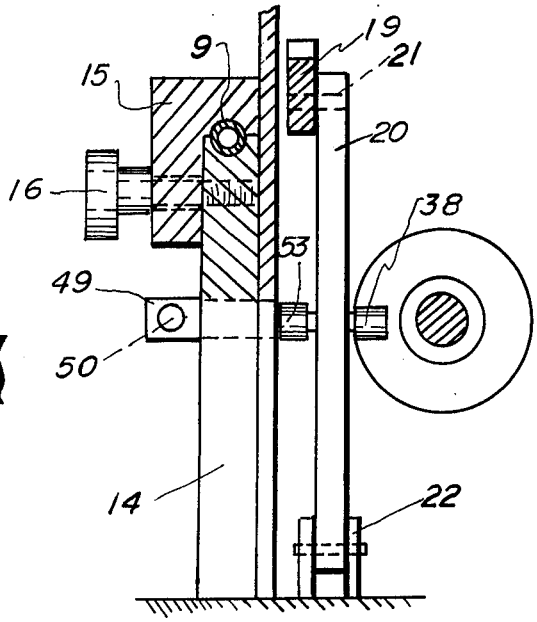
FIG. 5 is a fragmentary, detail sectional view taken substantially along the line 5—5 in FIG. 2.
Figure 7:
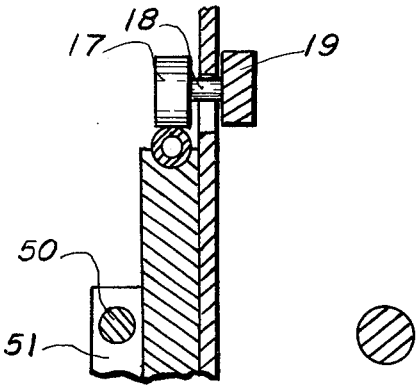
FIG. 7 is a fragmentary, detail sectional view taken substantially along the line 7—7 in FIG. 2.
Figure 6:
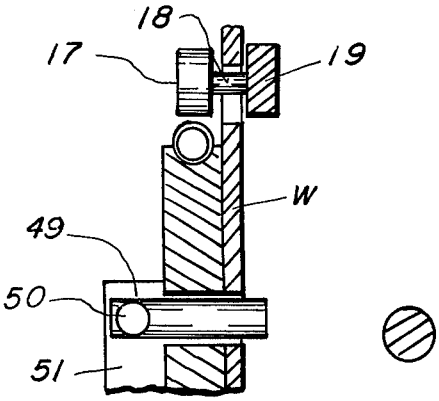
FIG. 6 is a fragmentary, detail sectional view taken substantially along the line 6—6 in FIG. 2.

The pumping mechanism 7 embodies an abutment member in the form of a roller 17 rotatably mounted on a shaft 18 disposed on one end portion of a lever 19, FIGS. 2, 3, 6 and 7, the lever 19 being pivotally mounted at its midpoint on the upper end portion of an upright lever 20 by a pin 21, FIGS. 3 and 5. The lever 20 is pivotally mounted at its lower end portion in a suitable supporting bracket 22 stationarily mounted in the machine 3.

Figure 4:
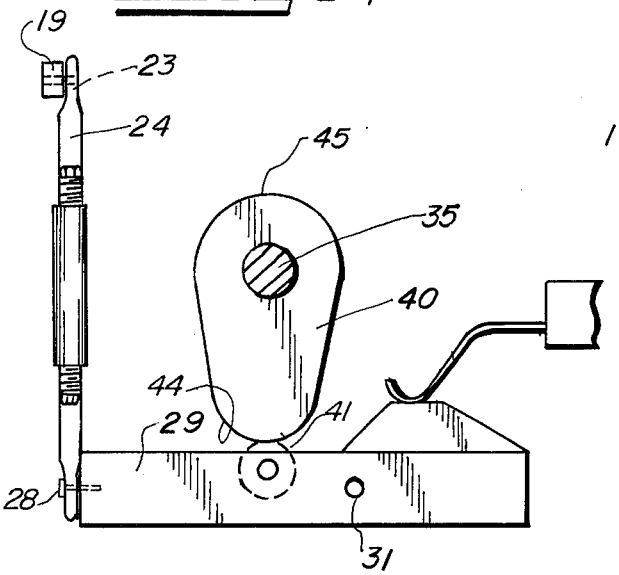
FIG. 4 is a fragmentary, detail sectional view taken substantially along the line 4—4 in FIG. 2.

The end of the lever 19, remote from the end on which the roller 17 is mounted, is pivotally connected by a pin 23 to the upper end portion of a rod 24, FIGS. 3 and 4. The rod 24 is of the turnbuckle type, embodying a central portion 25 threadedly connected to the two end portions 26 and 27 thereof for adjusting the latter axially toward and away from each other. The lower end portion 27 of the rod 24 is pivotally connected by a pin 28 to an end face of a lever 29, which is pivotally mounted in a supporting bracket 30 by a horizontally extending pin 31, for vertical rocking movement around the pin 31, as viewed in FIG. 4.

A tension coil spring 32, FIGS. 2 and 3, is operatively connected between the lever 20 and a bracket 33 which is stationarily secured to the frame of the machine 3. A cam 34 is mounted on, and rotatable with a drive shaft 35, FIGS. 2 and 3, which is journaled in suitable bearings 36 and 37 in the machine 3. During operation of the fluid-feeding mechanism 1, the drive shaft 35, preferably, is continuously rotated by any suitable means, such as, for example, a suitable motor, not shown. A cam follower 38, FIGS. 2, 3 and 5, is mounted on the lever 20 in position to be yieldingly held in engagement with the face 39 of the cam 34 by the spring 32. The rotation of the cam 34 with the drive shaft 35 is effective to cause the lever 20 to oscillate around its interconnection with the supporting bracket 22, and thereby cause the roller 17 to reciprocate left and right, as viewed in FIG. 2, longitudinally along the tubular member 9, for a purpose which will be discussed in greater detail presently.

Another cam 40, FIGS. 2 and 4, is mounted on the drive shaft 35 for rotation therewith. A cam follower 41 is mounted on the lever 29 at the same side of the pivot pin 31 as the interconnection of the lever 29 with the rod 24, and is engaged with the outer periphery of the cam 40. A tension coil spring 42, FIGS. 2 and 3, is operatively connected between the end portion of the lever 19 on which the roller 17 is mounted and a bracket 43, which is stationarily secured to the frame of the machine 3. The roller 17 is disposed in directly overlying relation to the tubular member 9 and it is so disposed that during a rotation of the drive shaft 35, it is first moved by the urging of the spring 42, downwardly from the position shown in FIG. 10, wherein it is disposed in upwardly spaced, closely adjacent relation to the tubular member 9, into the position shown in FIG. 11, wherein it is disposed in position to firmly squeeze and clamp the tubular member 9 against the underlying supporting member 14, the cam follower 41 riding upwardly or inwardly along the cam 40, as viewed in FIG. 4, from the outermost dwell 44 to the innermost dwell 45, by reason of the urging of the spring 42 during this portion of the rotation of the cam 40 with the drive shaft 35. Preferably, the force with which the roller 17 squeezingly engages the tube 9 is such that it is effective to completely close the tube 9 directly under the roller 17. During this same portion of the rotation of the drive shaft 35, the cam follower 38 on the lever 20 rides along the outermost dwell 46 on the cam 34, so that the lever 20 is held against pivotal movement relative to supporting bracket 22.

Figure 11:
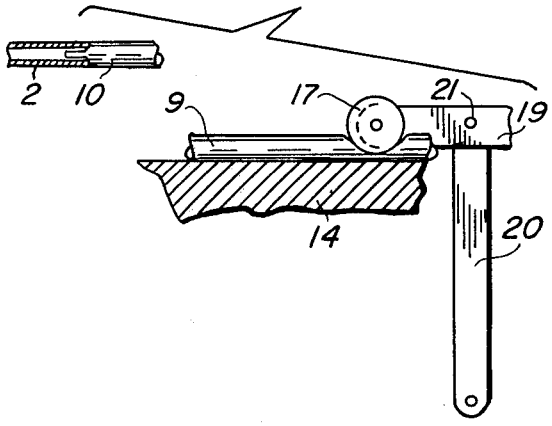

After the roller 17 has been moved into clamping engagement with the tubular member 9, as shown in FIG. 11, the cam follower 41 rides onto the dwell portion 45 of the cam 40 so that the roller 17 is yieldingly held in squeezing or clamping relation to the tubular member 9 by the spring 42. At this time, the cam follower 38 on the lever 20 rides inwardly along the cam surface 47, FIG. 3, from the outer dwell portion 46 onto the inner dwell portion 48 of the cam 34. During this movement of the cam follower 38 along the cam surface 47, the spring 32 is effective to cause the lever 20 to rotate in a counter-clockwise direction around the supporting bracket 22, as viewed in FIG. 3, to thereby move the roller 17 to the left, as viewed in FIG. 2, from the position shown in FIG. 11 to the position shown in FIG. 12. Such movement of the roller 17 is effective to force a pre-determined amount of fluid to the left, as viewed in FIG. 2, along tubular member 9, and thereby eject the predetermined amount of fluid outwardly through the nozzle 10, the amount of fluid so ejected through the nozzle 10 being determined by the length of stroke of the roller 17 along the tubular member 9.

The length of the path of movement of the roller 17 along the tubular member 9 may be determined by the positioning of an abutment member 49, FIG. 2, which is journaled on one end of an adjustment screw or feed screw 50, which is rotatably mounted in and supported by a suitable internally threaded supporting member 51 mounted on the wall W, the abutment member 49 being movable with the screw 50 during movement of the latter in a longitudinal direction through the supporting member 51. A suitable handle 52 is mounted on the other end of the screw 50, and adjustment of the abutment member 49 to various positions along the tubular member 9 may be effected by rotation of the handle 52. The abutment member 49 extends inwardly toward the side wall W of the machine 3 from the feed screw 50 into position to abuttingly engage an abutment member 53 mounted on the lever 20 on the side thereof remote from the cam follower 38, FIG. 5. The positioning of the feed screw 50, and, therefore, of the abutment member 49, is effective to determine the length of stroke of the roller 17 along the tube 9, and thereby determines the amount of fluid ejected through the nozzle 10 during one movement of the roller 17 to the left, as viewed in FIG. 2, along the tube 9 during a pumping operation of the pumping mechanism 7.

Thereafter, during continued rotation of the drive shaft 35, the cam follower 41 rides outwardly or downwardly, as viewed in FIG. 4, from the inner dwell 45 to the outer dwell 44 on the cam 40 to thereby cause the lever 29 to rotate in a counter-clockwise direction, as viewed in FIG. 4. This rotation of the lever 29 is effective to pull the rod 24 downwardly and thus rotate the lever 19 in a clockwise direction, as viewed in FIG. 3, and thereby move the roller 17 upwardly out of the squeezing engagement with the tubular member 9, illustrated in FIG. 12, to the position illustrated in FIG. 13, wherein the roller 17 again is disposed in outwardly spaced, but closely overlying relation to the tubular member 9.

Figure 10:
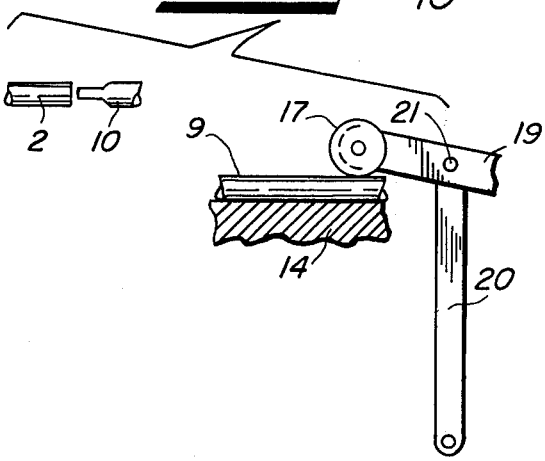
FIG. 10–13 are somewhat diagramatic, fragmentary detail sectional views showing a portion of the pumping mechanism, embodied in the machine shown in FIG. 1, in different operative positions.
Figure 12:
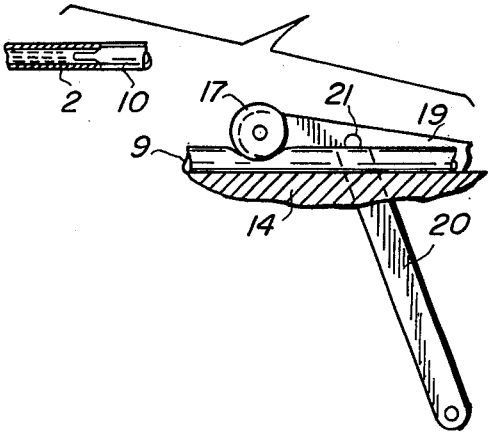
Figure 13:
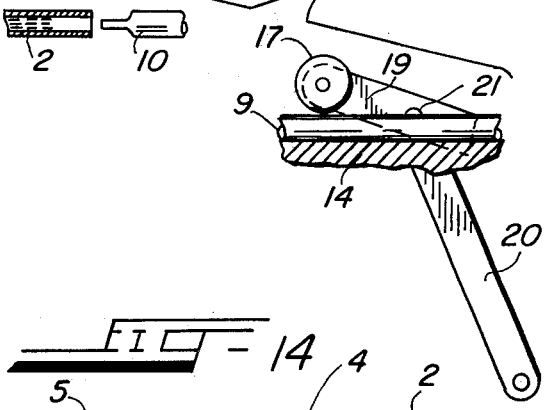

During this outward movement of the roller 17 from the position shown in FIG. 12 to the position shown in FIG. 13, the cam follower 38 on the lever 20 is riding along the innermost dwell 48 on the cam 34, so that the cam 34 is ineffective to cause the lever 20 to move against the urging of the spring 32. After the roller 17 has been moved into the outer position shown in FIG. 13, the cam follower 38 moves outwardly along the cam surface 47*a*, FIG. 3, onto the outermost dwell 46 on the cam 34. During this movement of the cam follower 38 along the cam surface 53, the lever 20 is caused to rotate around the hanger bracket 22 in a clockwise direction, as viewed in FIG. 3, against the urging of the spring 32. This movement of the lever 20 is effective to move the roller 17 to the right, as viewed in FIGS. 2, 10 and 13, from the position shown in FIG. 13 back to the initial starting position of the roller 17, as illustrated in FIG. 10. The pumping mechanism 7 is then in condition to start the next pumping cycle of operation.

It will be remembered that, in addition to the pumping mechanism 7, the mechanism 1 for feeding fluid also embodies a flow-control mechanism 11. The latter embodies an elongated, upstanding lever 54, pivotally mounted at its lower end portion in a hanger bracket 55 by a pin 56, FIGS. 2 and 3. An abutment member, in the form of a blade 57, is rigidly secured to the upper end portion of the lever 54, in immediately rearwardly disposed position relative to a portion of the tubular member 9, which is disposed in a housing 58, mounted on the supporting member 14, FIGS. 2 and 8. A slot 59 extends through the wall W between the blade 57 and the housing 58, FIGS. 2 and 8, and the slot 59 is of such size that the blade 57, upon oscillation of the lever 54 around the pivot pin 56 may move outwardly and inwardly through the slot 59 into and out of engagement, respectively, with the portion of the tubular member 9 disposed in the housing 58.

Figure 8:
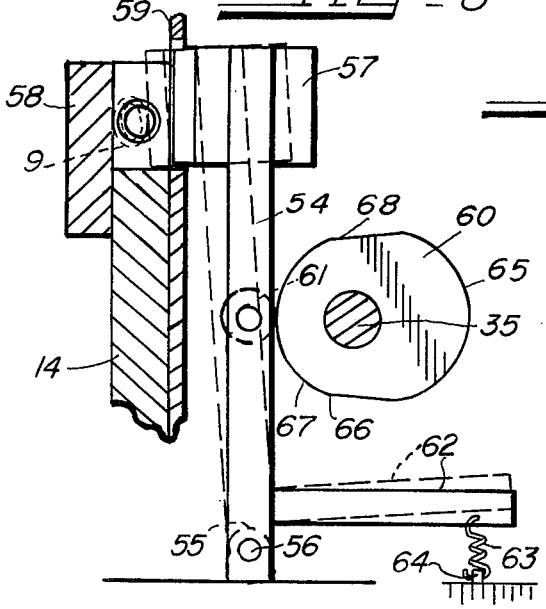
FIG. 8 is a fragmentary, detail sectional view taken substantially along the line 8—8 in FIG. 2.

Another cam 60 is mounted on and rotatable with the drive shaft 35, and the outer periphery thereof is disposed in engagement with a cam follower 61 mounted on the lever 54, FIGS. 2, 3 and 8. The lever 54 includes a rearwardly projecting arm 62, FIG. 8, and a tension coil spring 63 is connected between the arm 62 and a bracket 64 stationarily mounted in the machine 3, in position to yieldingly urge the lever 54 in a clockwise direction around the pivot pin 56, as viewed in FIG. 8, to thereby yieldingly hold the cam follower 61 in engagement with the outer periphery of the cam 60.

During the initiation of a cycle of operation of the mechanism 1, wherein the roller 17 and the levers 19 and 20 are disposed in the aforementioned position shown in FIG. 10, the cam follower 61 is disposed in engagement with the outer dwell 65 on the cam 60 so that the latter is effective to hold the lever 54 in the position shown in broken lines in FIG. 8, wherein the blade 57 is effective to closingly clamp the tube 9 against the housing 58, to thereby prevent the flow of fluid from the reservoir 8 past the blade 57 toward the nozzle 10. During the movement of the roller 17 into clamping or squeezing engagement with the tubular member 9, as shown in FIG. 11, the cam follower 61 rides along the cam surface 66 on the cam 60, FIG. 8, onto the inner dwell 67, to thereby permit the lever 54 to be moved by the spring 63 into the position shown in solid lines in FIG. 8, wherein the blade 57 is disposed outwardly of but in closely adjacent relation to tubular member 9, to thus open the tubular member between the roller 17 and the nozzle 10 for the passage of fluid therethrough.

During continued rotation of the drive shaft 35, while the roller 17 moves along the tubular member 9 from the position shown in FIG. 11 to that shown in FIG. 12, the cam follower 61 rides along the inner dwell 67, so that the lever 54 is held in retracted position and the blade 57 is ineffective to close the tubular member 9, the roller 17, during this portion of the cycle of operation, being effective to cause fluid to be ejected from the nozzle 10, as previously described.

During the next portion of the cycle of operation, wherein the roller 17 is moved outwardly from the position shown in FIG. 12 to that shown in FIG. 13, the cam follower 61 rides along the cam surface 68 back onto the outer dwell 65. During this movement of the cam follower 61, the lever 54 is again pressed inwardly by the cam 60 into the position shown in broken lines in FIG. 8 wherein the blade 57 is effective to again close the tubular member 9. Thus, during movement of the roller 17 into and out of closing relation to the tubular member 9, the blade 57 is moved in the reverse direction, so that it is moved out of and into closing relation to the tubular member 9, respectively.

The mechanism 1, embodied in the machine 3, also includes a nozzle-control mechanism 12. This includes an elongated slide member 69, one end of which carries the coupling 13 by which nozzle 10 is connected to the tubular member 9. The slide member 69 has an elongated slot 70 extending longitudinally through the end portion thereof remote from the coupling 13, and a screw 71 extends through the slot 70 and is threadedly engaged in a supporting member 72 attached to and carried by the upper end portion of an elongated lever 73, FIGS. 2, 3 and 9. The lower end portion of the lever 73 is pivotally mounted in a supporting bracket 74 by a pin 74, FIGS. 3 and 9.

Figure 9:
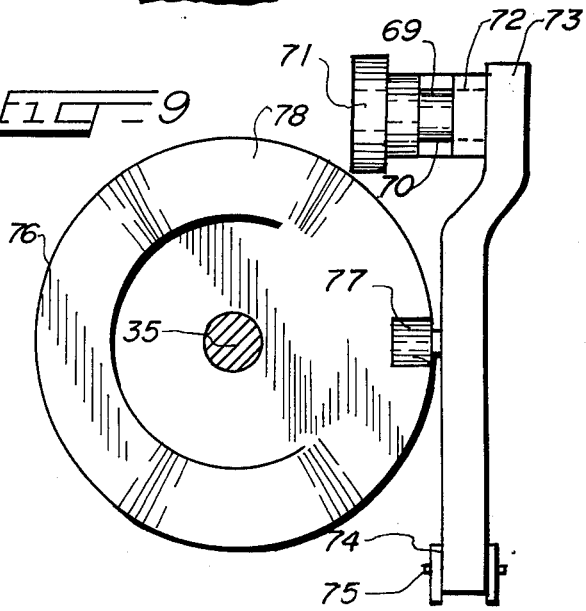
FIG. 9 is a fragmentary, detail sectional view taken substantially along the line 9—9 in FIG. 2.

Another cam 76 is mounted on and rotatable with the drive shaft 35, FIGS. 2, 3, and 9, and a cam follower 77, mounted on the lever 73, is engaged with the face 78 of the cam 76. A tension coil spring 79 is connected between the upper end portion of the lever 73 and a bracket 80 stationarily mounted on the frame of the machine 3, and is effective to yieldingly hold the cam follower 77 in engagement with the face 78 of the cam 76.

The nozzle 10 is slidably mounted in a supporting member 81, which is disposed in the machine 3, FIGS. 2 and 3, the nozzle 10 being supported thereby in axially aligned relation to the position occupied by the capsules, such as the capsule 2, when the latter are disposed in operative position in machine 1, as shown in FIGS. 2 and 3. The position of the nozzle 10, axially, relative to the capsules 2 may be manually adjusted by loosening screw 71, and sliding the slide 70 to the left or right, as viewed in FIGS. 2 and 3, along the supporting member 72 and then again tightening the screw 71 to secure the slide 70 and the nozzle 10 in adjusted position.

At that portion of the cycle of operation of the mechanism 1, wherein the roller 17 and the levers 19 and 20 are disposed in the aforementioned position illustrated in FIG. 10, the nozzle 10 is disposed in outwardly spaced relation to capsule-filling position, as illustrated in FIGS. 1–3 and 10. During this positioning of the nozzle 10, the cam follower 77 is disposed in engagement with the outer dwell portion 82 of the cam surface 78, the cam 76 thus being effective to hold the lever 73 in the position shown in FIGS. 2 and 3, against the urging of the spring 79, to thereby hold the nozzle 10 in outwardly spaced relation to the capsule 2 disposed in operative position in the holding means 6.

Thereafter, while the roller 17 and the levers 19 and 20 are moving from the position illustrated in FIG. 10 into the position shown in FIG. 11, the cam follower 77 rides inwardly off from the outer dwell 82 of the cam surface 78 onto the inner dwell 83 thereof, to thereby permit the lever 73 to be pivoted by the spring 79 around the pin 75 in a counter clockwise direction, as viewed in FIG. 3, and thus move the nozzle 10 into inserted engagement with the capsule 2 disposed in the supporting means 6, as illustrated in FIG. 11.

Thereafter, during a pumping operation of the pumping mechanism 7, wherein the roller 17 moves along the tubular member 9 from the position shown in FIG. 11 to the position shown in FIG. 12, the cam follower 77 rides along the inner dwell 83 of the cam 76 so that the nozzle 10 remains in inserted position in the capsule 2, wherein it is effective to discharge fluid, fed through the tubular member 9 by the pumping mechanism 7, into the body portion 4 of the capsule 2 disposed at the fluid-receiving station in the supporting means 6.

Next, during the portion of a cycle of operation wherein the roller 17 is moved outwardly from squeezing relation to the tubular member 9, as shown in FIG. 12, into the closely overlying relation thereto, as shown in FIG. 13, the cam follower 77 again rides outwardly onto the outer dwell portion 82 of the cam surface 78 to thereby force the lever 73 to pivot in a clockwise direction around the pin 75, as viewed in FIG. 3, and thereby retract the nozzle 10 into outwardly spaced relation to the filled capsule 2, as shown in FIG. 13. During the remainder of the cycle of operation, during which the roller 17 and the levers 19 and 20 are again moved from the position shown in FIG. 13 back into the position shown in FIG. 10, the cam follower 77 remains in engagement with the outer dwell 82 of the cam surface 78 so that the nozzle 10 is retained in the aforementioned retracted position.

Thus, it will be seen that in each cycle of normal operation of the mechanism 1, the pumping mechanism 7, the flow-control mechanism 11 and the nozzle control mechanism 12 are all actuated in timed relation to each other, during a single rotation of the drive shaft 35, to thereby, first, simultaneously move the roller 17 into squeezing relation to the tube 9 and move the blade 57 out of squeezing rotation thereto, while the nozzle 10 is moving into inserted relation to the capsule 2; then move the roller 17 along the tube 9 in a pumping stroke, to thereby feed fluid through the nozzle 10 into the capsule 2; thereafter, simultaneously, move the roller 17 out of, and the blade 57 into squeezing relation to the tube 9, while retracting the nozzle 10 from the capsule 2; and then move the roller 17 back along the tube 9 into its initial starting position, while maintaining the nozzle 10 in retracted position and maintaining the blade 57 in squeezing relation to the tube 9.

In the preferred form of the mechanism 1 shown in the drawings a sensing device, which may be of any suitable type, such as, for example, a switch 84, FIG. 2, is disposed at the fluid-receiving station for the capsules 2. The switch 84 is connected to a suitable source of power, not shown, and is connected by suitable conductors, not shown, to a solenoid 85 embodied in the flow-control mechanism 11, FIG. 2. The solenoid 85 is disposed in closely adjacent relation to the arm 62 on the lever 54, as shown in FIGS. 2 and 3. It is so positioned relative to the arm 62 that when the blade 57 on the lever 54 is disposed in clamping relation to the tubular member 9 and the core 86 is disposed in extended position, as shown in broken lines in FIG. 2, the core 86 is disposed in underlying engagement with the arm 62 so that the lever 54 can not be rotated around the pin 56 in a clockwise direction, and thus the blade 57 is positively held in clamping relation to the tubular member 9, in which position it is effective to close the latter against the flow of fluid therethrough. The aforementioned extended position of the core 86 is the normal position thereof, when the solenoid 85 is not electrically energized. This condition occurs, of course, when the switch 84 is in "open" condition.

The switch 84 is so constituted and arranged that, when a capsule, such as the capsule 2 shown in FIGS. 2 and 3, is disposed in the holding means 6 in normal fluid-receiving position, the capsule 2 operatively engages the sensing portion 87 of the switch 84 to thereby close the switch 84 and thus energize the windings of the solenoid 85. This is effective to retract the core 86 and thus free the lever 54 for rotation in a clockwise direction, as viewed in FIG. 8, to permit the blade 57 to be retracted from clamping engagement with the tubular member 9. On the other hand, it will be observed that, in the event of a malfunction of the machine 1, wherein a capsule 2 is not fed into fluid-receiving position in the supporting means 6, the switch 84, upon completion of a cycle of operation of the mechanism 1 will remain open and thus cause the core 86 to remain in latching engagement with the arm 62 of the lever 54 so as to prevent the blade 57 from being retracted from clamping relation to the tube 9, and thus prevent fluid from flowing past the blade 57 in the tube 9. This, it will be seen, affords effective insurance against the wasting of fluid from the reservoir 8, by the discharge thereof from the nozzle 10 when a capsule, such as the capsule 2, is not disposed in fluid-receiving relation thereto.

From the foregoing it will be seen that the present invention affords a novel mechanism for feeding fluid in capsule-filling machines, and the like.

In addition, it will be seen that the present invention affords a novel pumping mechanism, which is particularly well-adapted for use in such machines.

Also, it will be seen that the present invention affords novel safety controls for insuring against accidental leakage or ejection of fluid from such a machine.

Also, it will be seen that the present invention affords a novel and practical mechanism for feeding fluid in capsule-filling machines, and the like, which mechanism is practical and efficient in construction and operation, and which may be readily and economically produced commercially.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I claim:

1. In a capsule-filling machine embodying means for holding a capsule body portion in position to receive fluid therein, a. a reservoir for holding a supply of such fluid.
b. a nozzle for feeding said fluid into a capsule body portion,
c. a flexible, resilient tubular member operatively connected between said reservoir and said nozzle for feeding such fluid there-between,
d. a drive shaft,
e. means for rotating said drive shaft,
f. means, including a cam mounted on said drive shaft, for pumping fluid through the tubular member from said reservoir to said nozzle,
g. means for moving said nozzle between
1. One position wherein it is disposed in operative position in said body portion, and
2. another position wherein it is disposed in outwardly spaced relation to said body portion,
h. said means for moving said nozzle comprising
1. a second cam mounted on said drive shaft and rotatable with said first mentioned cam, and
2. a cam follower connected to said nozzle and engaged with said second cam,
i. an abutment member
1. disposed between said pumping means and said nozzle, and
2. movable into and out of clamping engagement with said tubular member for closing and opening the latter, respectively,
j. means for moving said abutment member in timed relation to said pumping means, whereby
1. said abutment member is disposed out of said clamping engagement with said tubular member during pumping operation of said pumping means, and
2. said abutment member is disposed in said clamping engagement with said tubular member when said pumping means is not operating to pump fluid from said reservoir to said nozzle,
k. said means for moving said abutment member comprising a third cam mounted on said drive shaft and rotatable with said first mentioned cam and said second cam,
l. means for sensing whether a capsule body portion is disposed in said position to receive fluid therein, and
m. a solenoid operatively connected to said means for sensing, and controlled thereby, for rendering said abutment member inoperative to move out of said clamping engagement when a capsule body portion is not disposed in said position to receive fluid therein.

2. The combination defined in claim 1, and in which
a. said means for moving said abutment member comprises
1. a third cam mounted on said drive shaft and rotatable with said first mentioned cam and said second cam for moving said abutment member into said clamping engagement with said tubular member, and
2. spring means operatively connected to said abutment member for yieldingly urging the latter out of said clamping engagement with said tubular member against the urging of said third cam.

3. In a capsule-filling machine embodying means for holding a capsule body portion in horizontally extending position for receiving fluid therein,
a. a reservoir for holding a supply of such fluid,
b. an elongated nozzle for feeding such fluid into a capsule body portion,
c. stationary supporting means for slidably supporting said nozzle for longitudinal reciprocation in a horizontal direction,
d. a flexible, resilient tubular member operatively connected between said reservoir and said nozzle for feeding said fluid there-between,
e. a drive shaft,
f. means for rotating said drive shaft,
g. means, including a cam mounted on said drive shaft, for pumping fluid through the tubular member from said reservoir to said nozzle,
h. means for longitudinally moving said nozzle horizontally relative to said supporting means between
1. one position wherein it is disposed in operative position in said body portion, and
2. another position wherein it is disposed in outwardly spaced relation to said body portion,
i. said means for moving said nozzle comprising
1. a second cam mounted on said drive shaft and rotatable with said first mentioned cam, and
2. a cam follower connected to said nozzle and engaged with said second cam,
j. an abutment member
1. disposed between said pumping means and said nozzle, and
2. movable into and out of clamping engagement with said tubular member for closing and opening the latter, respectively,
k. means for moving said abutment member in timed relation to said pumping means, whereby
1. said abutment member is disposed out of said clamping engagement with said tubular member during pumping operation of said pumping means, and
2. said abutment member is disposed in said clamping engagement with said tubular member when said pumping means is not operating to pump fluid from said reservoir to said nozzle,
l. said means for moving said abutment member comprising a third cam mounted on said drive shaft and rotatable with said first mentioned cam and said second cam.

* * * * *